United States Patent [19]

Viertlboeck

[11] 4,221,096

[45] Sep. 9, 1980

[54] ROOF STRUCTURE

[76] Inventor: Anthony M. Viertlboeck, 2323 Shoreland, Apt. A112, Toledo, Ohio 43611

[21] Appl. No.: 939,413

[22] Filed: Sep. 5, 1978

[51] Int. Cl.[2] ..... E04D 1/00

[52] U.S. Cl. ..... 52/553; 52/465; 52/199

[58] Field of Search ..... 52/553, 518, 465, 409, 52/631, 90, 459, 460, 309.1, 412, 413, 199

[56] References Cited

U.S. PATENT DOCUMENTS

| | | | |
|---|---|---|---|
| 1,119,946 | 12/1914 | Gedge | 52/518 X |
| 1,376,751 | 5/1921 | Edwards | 52/553 X |
| 1,865,771 | 7/1932 | Levy | 52/553 X |
| 2,966,764 | 1/1961 | Booth | 52/465 |
| 3,671,371 | 6/1972 | Wolf | 52/309.1 X |

*Primary Examiner*—Price C. Faw, Jr.

*Assistant Examiner*—Carl D. Friedman

*Attorney, Agent, or Firm*—Emch, Schaffer, Schaub & Todd

[57] ABSTRACT

An improved roof structure using flexible sheets of waterproof roofing material such as a felt backed polyvinyl chloride. An inverted generally V-shaped channel joins adjacent edges of the sheets of material. The channels have sides and an apex extending above the normal maximum water level on the roof structure during heavy rains. The adjacent edges of the material are bonded to the opposite sides of the channel and are further sealed by overlapping and bonding together or by a bonding to the inside of a second, overlapping inverted V-shaped channel. The air space in the first generally V-shaped channel may be vented to the atmosphere to prevent sweating beneath the roofing material.

9 Claims, 12 Drawing Figures

FIG. 1
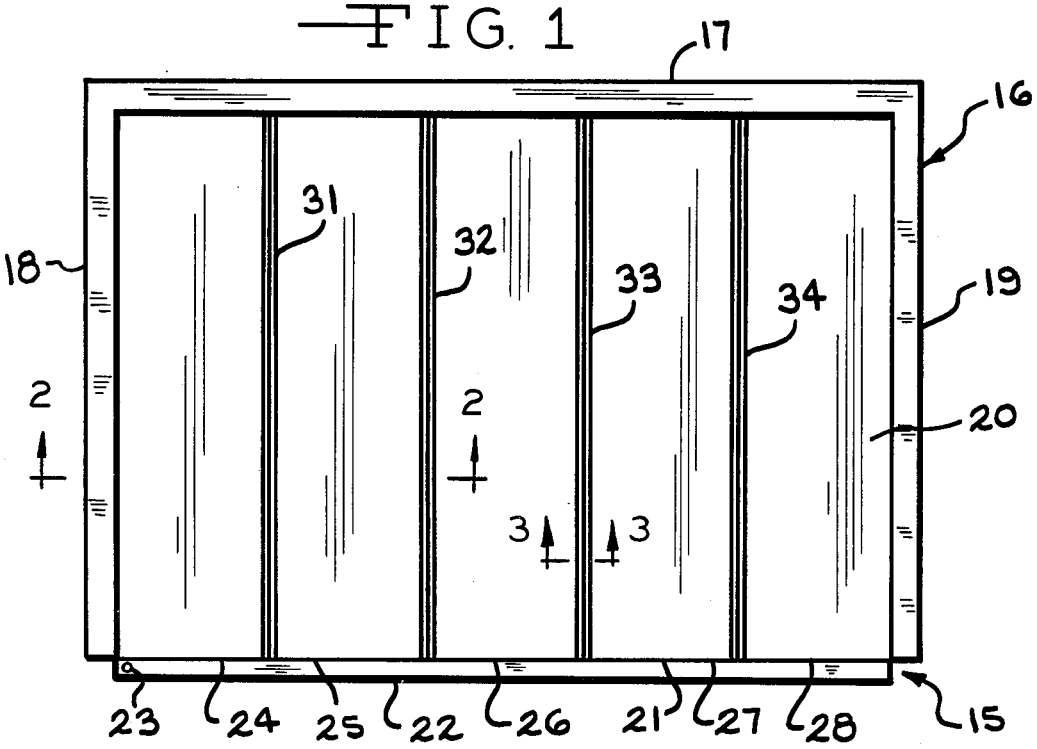
FIG. 2
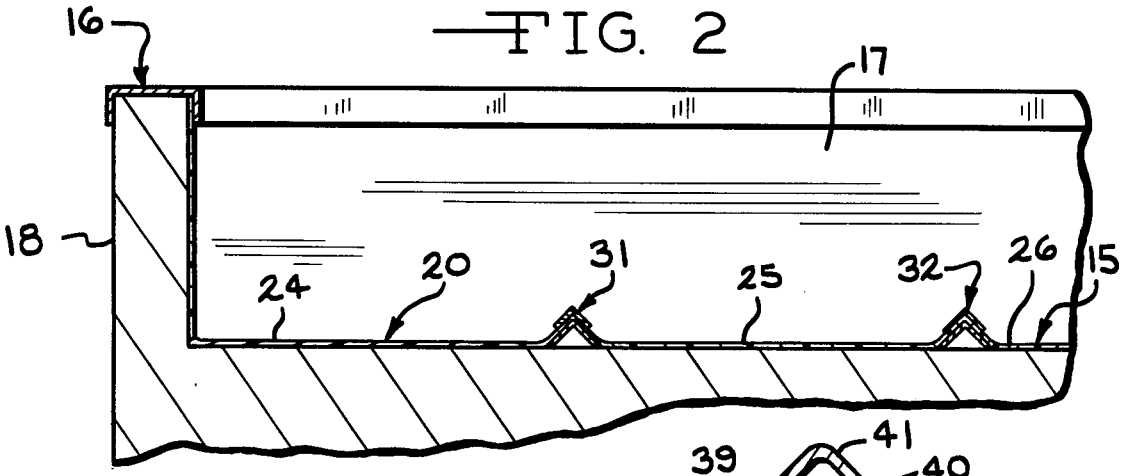
FIG. 4
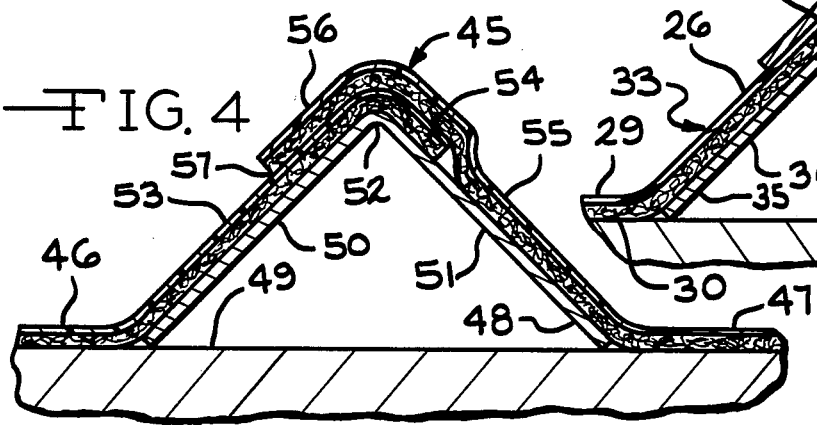
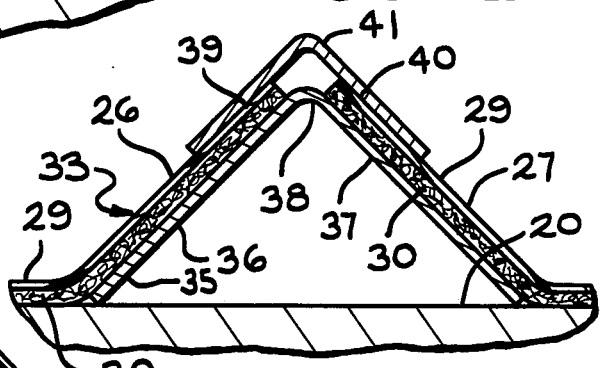
FIG. 3

FIG. 9
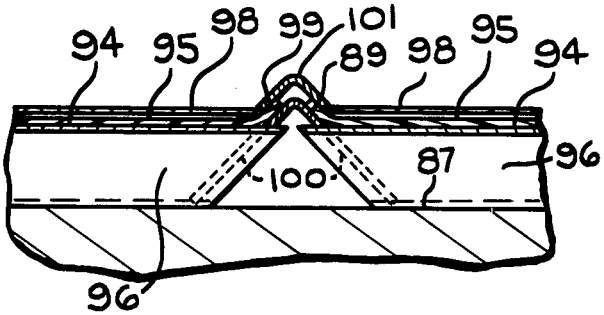
FIG. 10
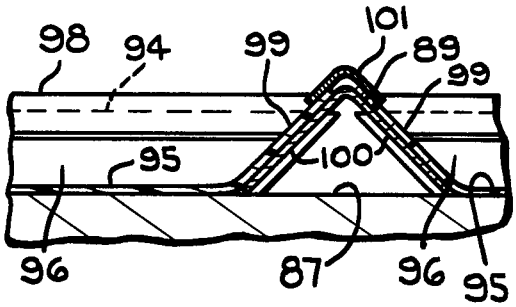
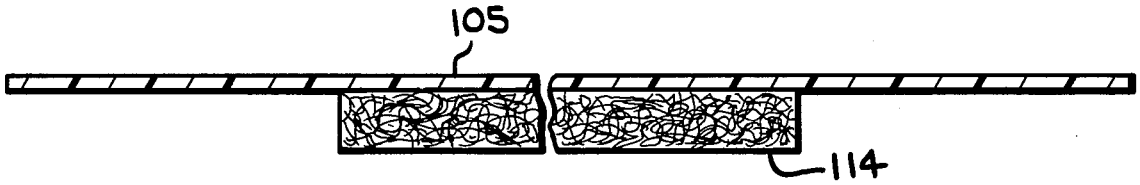
FIG. 11
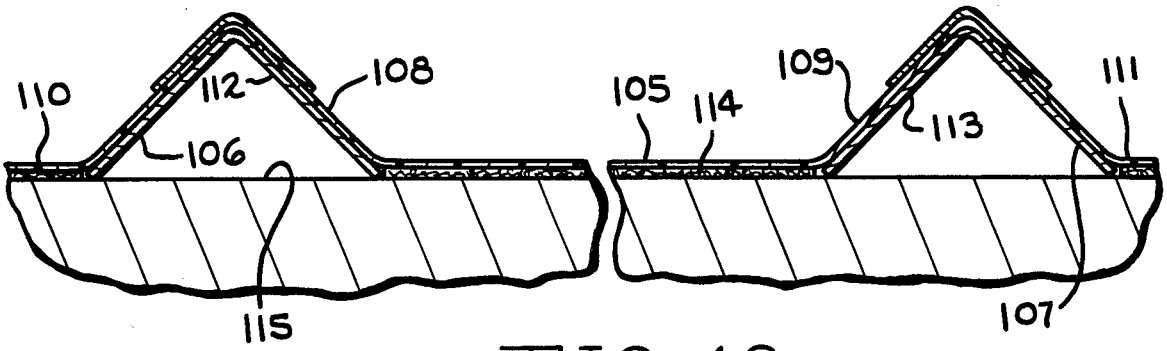
FIG. 12

ROOF STRUCTURE

BACKGROUND OF THE INVENTION

This invention relates to static structures and more particularly to an improved cover or roofing structure for buildings.

Many commercial buildings, such as stores, theaters, and the like, are provided with a nearly flat roof. Because of the small slope to the roof, roofing shingles are not suitable as a roofing material since water can enter under the overlapping shingles. Typically, the roofing structure for a building of this type is built up from layers of tar paper, tar and stones to obtain a waterproof construction. However, considerable labor and expense is required to install a roof of this type. Furthermore, additional tar and stones periodically must be applied to the roof in order to maintain its waterproof integrity.

Another and less expensive type of roof construction for buildings having nearly flat roofs involves the use of sheets of a synthetic resinous material, such as sheets of a felt backed polyvinyl chloride. The sheets are unrolled across the roof with the edges of adjacent sheets overlapped. A waterproof mastic or adhesive is then applied to the overlapping edges to seal the edges together. This roof structure is relatively inexpensive to apply. However, the structure has a limited durability, particularly at the joints between adjacent sheets of the material. During heavy rains, the joints will be under water and subject to at least a small pressure head. As the joints age, they will tend to leak due to a breakdown of the mastic or adhesive. Another problem occurs with sweating. Any moisture absorbed by the building prior to application of the roof tends to collect between the vinyl roofing material and the building. This moisture can adversely affect the lifetime of the roofing material and of the building roof itself, particularly when the roof is formed from wood.

SUMMARY OF THE INVENTION

According to the present invention, an improved roofing structure is provided for buildings having nearly flat roofs. The roofing structure involves the use of flexible sheets of a waterproof roofing material, such as a felt backed polyvinyl chloride, and a novel joint construction for sealing together adjacent sheets of such material. An inverted channel, preferably a generally V-shaped channel, joins adjacent edges of the sheets of material. The channels have sides and an apex extending from the roof to above the normal maximum water level on the roof structure. The adjacent edges of the sheets of material are bonded to the opposite sides of the channel with a suitable mastic or adhesive and are further sealed either by overlapping and bonding together or by a second, overlapping inverted V-shaped channel. The inner surfaces of the second channel are bonded to the edges of the two sheets of material with a suitable adhesive or mastic. The lower V-shaped channel may be vented to the atmosphere to prevent sweating and moisture accumulation beneath the sheets of roofing material.

Accordingly, it is a preferred object of the invention to provide an improved roof structure for buildings.

Another object of the invention is to provide a roof structure for buildings having substantially flat roofs and using sheets of flexible water proof roofing material joined together by a novel joint construction.

Other objects and advantages of the invention will become apparent from the following detailed description, with reference being made to the accompanying drawings.

BRIEF DESCRIPTION OF THE DRAWINGS

FIG. 1 is a top plan view of a building having an improved roof structure constructed in accordance with the present invention;

FIG. 2 is an enlarged cross sectional view taken along line 2—2 of FIG. 1;

FIG. 3 is an enlarged cross sectional view taken alone line 3—3 of FIG. 1 and showing details of one joint construction;

FIG. 4 is an enlarged cross sectional view, similar to FIG. 3, but showing a modified joint construction;

FIG. 9 is a cross sectional view taken along line 9—9 of FIG. 7;

FIG. 10 is a cross sectional view taken along line 10—10 of FIG. 7;

FIG. 11 is a cross sectional view through a modified sheet of flexible roofing material for use in the roof structure of the present invention; and FIG. 12 is a fragmentary cross sectional view through a roof structure in accordance with a further embodiment of the present invention using the roofing material of FIG. 11.

DESCRIPTION OF THE PREFERRED EMBODIMENTS

Figure 5:
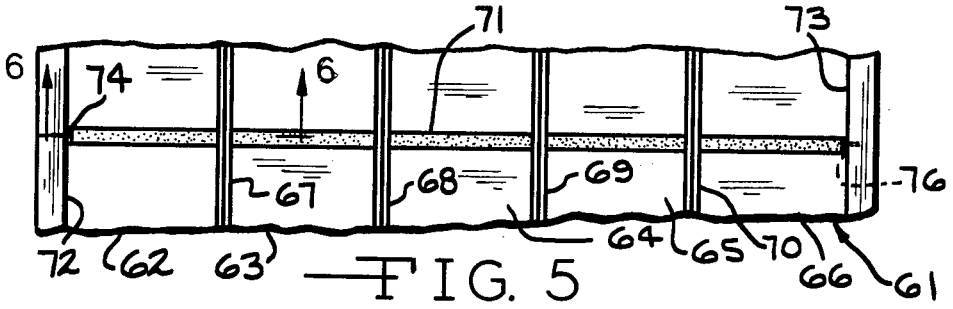
FIG. 5 is a fragmentary top plan view of a building having a modified embodiment of the roof structure of the present invention.

Turning now to the drawings and particularly to FIGS. 1–3, a roof structure 15 for a building 16 is shown constructed in accordance with one embodiment of the invention. The building 16 has a front wall 17 and two side walls 18 and 19 which extend above a slightly inclined roof 20 which slopes gently from the front wall 17 to a rear 21. An eaves trough 22 extends along the roof 20 at the building rear 21 for directing water to a drain 23.

The roof structure 15 is formed from a plurality of sheets of flexible waterproof roofing material, of which five sheets 24–28 are illustrated in FIG. 1. As best seen in FIG. 3, the sheets 24–28 preferably have a waterproofed outer surface 29 formed from an ultraviolet stabilized polyvinyl chloride or similar synthetic resinous material. A felt backing 30 of polypropylene or a similar stable material is bonded to the waterproofed surface 29. Edges of the adjacent sheets 24 and 25 are connected together at a joint 31, the adjacent sheets 25 and 26 are connected together at a joint 32, the adjacent sheets 26 and 27 are connected together at a joint 33 and the adjacent sheets 27 and 28 are connected together at a joint 34. The joints 31–34 extend parallel along the maximum slope of the roof 20.

Details of the joint 33 are shown in FIG. 3, with the remaining joints 31, 32 and 34 being of similar construction. An elongated inverted V-shaped channel 35 extends the length of the joint 33. The channel 35 has two sides 36 and 37 extending upwardly from the roof 20 and jointed at an apex 38. The apex 38 lies above the normal maximum water level encountered on the roof 20. The sheet of material 26 has an edge 39 which extends the length of and overlaps substantially all of the side 36 of the channel 35. Similarly, the sheet of material 27 has an edge 40 which extends the length of and overlaps substantially all of the side 37 of the channel 35. A suitable waterproof mastic or adhesive bonds the sheet edge 39 to the channel side 36 and bonds the sheet edge 40 to the channel side 37. A second and smaller V-shaped channel 41 is inverted, placed over and bonded to the sheet edges 39 and 40 with a suitable waterproof adhesive or mastic. The adhesive or mastic between the sheet edges 39 and 40 and the channels 35 and 41 may be, for example, a commercially available rubber adhesive such as is used for attaching vinyl tops to automobile roofs, a polyvinyl chloride adhesive or other commercial adhesives. The channel 41 directs rain away from the edges 39 and 40 of the sheets 26 and 27 of roofing material to prevent exposure of the edges 39 and 40 to rainwater. Since the edges 39 and 40 are not exposed to rainwater and are disposed above the maximum water level on the roof 20, there is no opportunity for water to seep under the sheets of roofing material 26 and 27 along the edges 39 and 40. Nor does the mastic or adhesive applied to the edges 39 and 40 deteriorate as in the past since it is not exposed to standing water.

Turning now to FIG. 4, a modified embodiment of a joint 45 is shown for two adjacent sheets 46 and 47 of roofing material. Again, the sheets of roofing material 46 and 47 preferably comprise a polypropylene felt backed polyvinyl chloride which is stabilized against deterioration from ultraviolet light. An inverted channel and preferably a generally V-shaped channel 48 again is positioned on a building roof 49 to extend the length of the joint 45 and also to extend in the direction of the slope of the roof 49. The channel 48 is shown as having two sides 50 and 51 which are adjoined together at an apex 52 which is disposed above the maximum water level on the roof 49. The sheet of flexible roof material 46 has a portion 53 which extends along and is bonded to the side 50 with a suitable waterproof mastic or adhesive. An edge 54 of the sheet 46 extends over the apex 52 and partially down the side 51 of the channel 48 and is bonded to the side 51 of the channel 48. Similarly, the sheet of flexible roofing material 47 has a portion 55 which extends over and is bonded to the side 51 of the channel 48 and the edge 54 of the sheet 46. An edge 56 of the sheet of material 47 extends over the apex 52 of the channel 48 and is bonded to the portion 53 of the sheet of material 46. The edge 56 protects the edge 54 of the sheet of material 46 from exposure to water. Furthermore, the edge 56 is downwardly directed to prevent water from entering a seam 57 where the edge 56 of the sheet of material 47 and the portion 53 of the sheet of material 46 are joined together. Preferably, the channel 48 is sufficiently high as to elevate the seam 57 above the water level on the roof 49 during heavy rains.

It should be noted that the channel 48 shown in FIG. 4 and the channel 35 shown in FIGS. 1-3 both are of a generally inverted, V-shaped configuration. The V-shaped channel works quite efficiently and is the least expensive of various commercially available channels. However, it should be appreciated that other channel configurations may be used and that the invention is not limited to the use of a V-shaped channel. For example, the channel may be on the order of a U-shape with a bight or curved portion replacing the apex on the V-shaped channel. Or, the channel may be in the form of an inverted T or in the form of other configurations which will be apparent to those skilled in the art.

Figure 6:
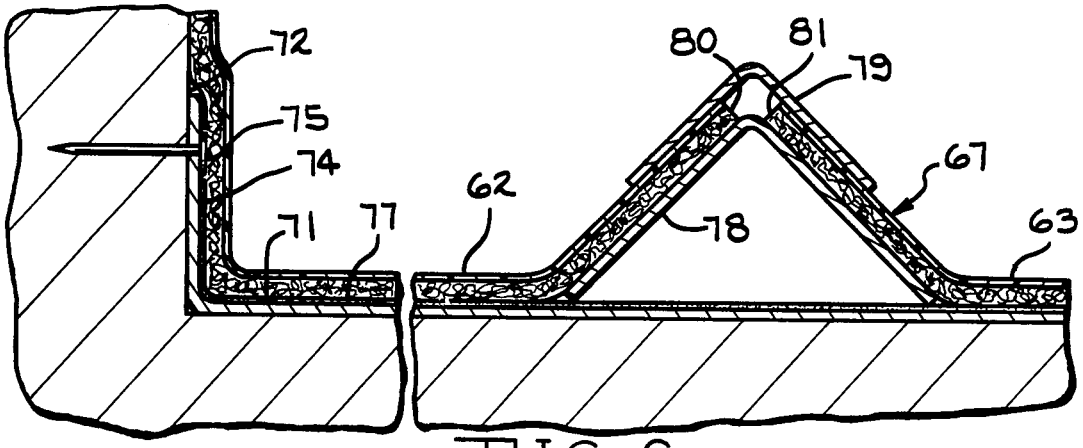
FIG. 6 is an enlarged cross sectional view taken along line 6—6 of FIG. 5.
Figure 7:
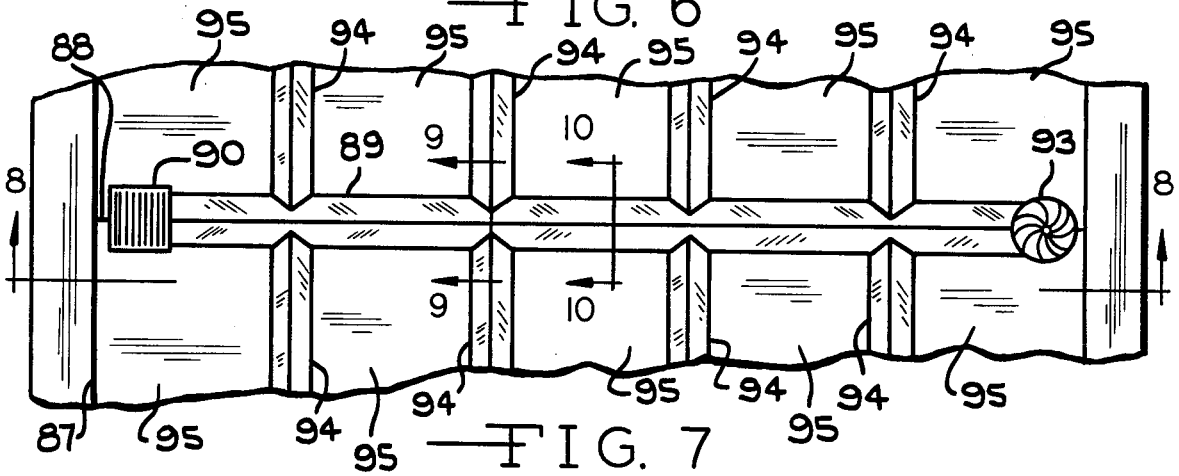
FIG. 7 is a fragmentary top plan view of a further modified roofing structure for a building in accordance with the present invention.
Figure 8:
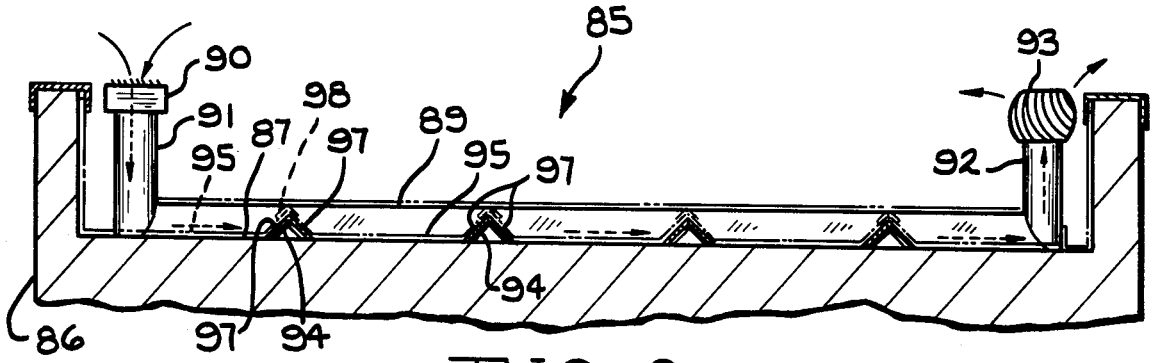
FIG. 8 is a cross sectional view taken along line 8—8 of FIG. 7.

Turning now to FIGS. 5 and 6, a modified embodiment of a roof structure 61 is shown in accordance with the present invention. Normally, it is necessary to attach the flexible sheets of roofing material to the building only along the sides of the building. However, in larger structures, it is sometimes desirable to provide additional means for attaching the flexible sheets of roofing material to the building. In the fragmentary view of FIG. 5, the roof structure 61 is shown as comprising five sheets of flexible roofing material 62-66 with adjacent sheets connected together at joints 67-70. The sheets of roofing material are formed from a water proof, flexible synthetic resinous material, such as an ultraviolet stabilized polyvinyl chloride. Preferably, the material is provided with a resilient backing such as a polypropylene felt type material. The joints 67-70 are similar in construction to the joints 31-34 shown in FIGS. 1-3 or the joint 45 shown in FIG. 4. Prior to placement of the sheets 62-66 of roofing material in constructing the roof structure 61, a metal strip 71 is laid to extend across the building roof between building sidewalls 72 and 73 in a direction perpendicular to the joints 67-70. The metal strip 71 has an end 74 which extends partially up wall 72 and is anchored with a nail 75 or other suitable fastener. Similarly, there is an end 76 extending partially up and anchored to the wall 73. An adhesive layer 77 is applied to the metal strip 71 and the sheets 62-66 of material are positioned on the roof structure 61. At each of the joints 67-70, a metal channel, such as an inverted V-shaped channel 78 illustrated in detail for the joint 67, is positioned on the roof structure 61 to extend between the adjacent sheets of material. The sheets 62-66 of flexible roofing material are then bonded to the channels with a suitable adhesive or mastic and also bond to the metal strip 71. As illustrated in FIG. 6, a second or smaller V-shaped channel 79 is positioned over the channel 78 to cover the ends 80 and 81 of the sheets 62 and 63 of material, respectively. The channel 79 is bonded to the ends 80 and 81 to prevent water from contacting these ends, while the channel 78 raises the ends 80 and 81 above the maximum water level on the roof structure 61.

Under normal circumstances, the individual sheets of material forming the roof structure of the present invention need not be anchored or attached to the building roof, except around the perimeter of the building. However, where the roof structure is used on large buildings or the building is located in an extremely windy location, a number of the metal strips 71 may be used to reduce possible damage to the roof structure. The metal strips 71 are spaced periodically across the roof to extend in a direction perpendicular to the joints 67-70 for the roof structure 61. Furthermore, it is necessary only to anchor the metal strips 71 at their ends, as shown in FIGS. 5 and 6. By bonding the individual sheets of material 62-66 to the spaced metal strips 71, the lateral stability of the roof structure 61 is greatly increased.

Prior art roof structures using a vinyl type roofing material have had difficulty with sweating under certain weather conditions. The sweat from the vinyl roofing material can collect under the vinyl material and cause a significant moisture problem for the roof. Referring to FIGS. 7-10, a roof structure 85 is shown for a building 86 which overcomes the problems of sweating under a vinyl type roof. The building 86 has a roof 87 which slopes gently away from either side of a peak 88. A channel 89 extends along the peak 88 of the roof 87. An inlet grill 90 is mounted atop a stack 91 at one end of the channel 89 and an exhaust stack 92 is mounted at the opposite end of the channel 89. A suitable fan, such as a wind or motor driven fan 93, is mounted on the exhaust stack 92 to cause air to flow through the inlet grill 90, the stack 91, the channel 89 and the stack 93.

A plurality of inverted, V-shaped channels 94 radiate outwardly and slope downwardly from the channel 89. The channels 94 are in open communication with the channel 89 so that fresh air is delivered from the channel 89 to the channels 94 for removing moisture therefrom. Edges of adjacent sheets 95 of a suitable flexible, waterproof roofing material, such as a polyvinyl chloride type material, are joined together along each of the channels 94. As best seen in FIGS. 9 and 10, side edges 96 of adjacent sheets 95 of the roofing material are bonded to the opposite sides 97 of the channels 94. An inverted V-shaped channel or cap 98 is then positioned over the channel 89 and is bonded to the side edges 96 of the two adjacent sheets of material 95 to prevent water from entering the joint formed along the channel 94. Similarly, end edges 99 on the sheets 95 of material are bonded to opposite sides 100 of the channel 89 and are covered and adhere to a second V-shaped channel 101 which prevents water from contacting and entering under the edges 99. Through this arrangement, a secure water-tight joint is formed along each of the channels 94 and 89. By causing air to circulate through the channels 89 and to supply fresh air to within the channels 94, sweating moisture is removed from between the sheets of material 95 and the building roof 87. During seasons when sweating is not a problem, the fan 93 can be disconnected and the inlet grill 90 can be covered, if desired.

The flexible sheets of roofing material shown in FIGS. 1–6 have been described and illustrated as preferably comprising a vinyl such as an ultraviolet stabilized polyvinyl chloride having a felt backing, for example, a polypropylene or of spun glass fibers. The felt backing has been described as being applied to the flat waterproof outer sheet. However, it should be appreciated that the felt may be applied directly to the roof and that the flat waterproof outer sheet then may be applied to cover the roof and the previously applied felt.

The sheets of flexible material shown in the embodiment of FIGS. 7–10 have omitted the felt backing. Where the roof structure of the present invention is installed over an old roof, it generally is desirable to have the felt backing to prevent puncturing the waterproof sheets when installation and maintenance personnel are walking on the roof. Puncturing can occur, for example, for a raised nail head or a stone lying under the vinyl roof. However, the felt backing is not a required element for the present invention and may be omitted, as illustrated in FIGS. 6–10.

A modified type of roofing material is shown in FIGS. 11 and 12. Here, the main component of the roofing material is again a flexible sheet 105 of an ultraviolet light stabilized polyvinyl chloride. As shown in FIG. 12, the sheet of material 105 extends between two channels 106 and 107 which form joints along edges 108 and 109 of the sheet 105 and edges of adjacent sheets 110 and 111 which extend on either side of the sheet 105. The edges 108 and 109 of the sheet 105 are bonded, respectively, to sides 112 and 113 of the channels 106 and 107. A spun polypropylene felt backing 114 is bonded to the sheet 105 to extend only between the channels 106 and 107. Therefore, the sheet 105, without the felt backing 114, is bonded to the channels 106 and 107. This provides a more water-tight bonding between the ends 108 and 109 and the channel sides 112 and 113, respectively, since a porous felt backing is not provided at these joints. However, the felt backing 114 is provided in contact with a building roof surface 115 to prevent damage to the sheet 105 when installers and maintenance personnel walk on the roof.

It will be appreciated that various modifications and changes may be made in the above-described preferred embodiments of the invention. For example, although the sheets of material used for the roofing have been described as ultraviolet light stabilized polyvinyl chloride and, preferably, have a spun polypropylene or a spun glass fiber felt backing, it will be appreciated that the backing is not required and that other well known types of materials may be substituted for the flexible sheets of roofing material and the felt. The primary considerations in selecting the roofing material are cost, durability over long exposure to the environment, flexibility and that the material be impervious to water. It also will be appreciated that the shapes of the channels used at the joints are not critical, although an inverted V-shaped channel is preferable due to its low cost. The primary consideration is that the channels raise the joints above the water level appearing on the roof structure under extreme weather conditions. Also, the channels may be formed from various material including metal, rubber and synthetic resins. Furthermore, the inner and outer channels may be of different materials; if desired. For example, the channel 35 shown in FIG. 3 may be of metal while the outer channel 41 is of a vinyl. In the embodiment of the invention shown in FIGS. 7–10, it is necessary that the channel be shaped to provide an air space at each joint for ciruclating air along the joint to remove moisture from between the roofing material and the building itself. It should also be appreciated that the joint construction and the overall roof structure of the present invention can be used on substantially flat roofs where there is no standing water. Other changes will be apparent to those skilled in the art without departing from the scope of the following claims.

What I claim is:

1. A joint construction for adjacent edges of sheets of flexible waterproof roofing material in a roof structure, comprising an inverted generally V-shaped channel having first and second sides joined at an apex extending above the normal maximum water level on said roof structure, waterproof means bonding an adjacent edge of one sheet of said flexible waterproof roofing material to one side of said V-shaped channel, waterproof means bonding an adjacent edge of said other sheet to the other side of said channel, said adjacent edges of said sheets being bonded to said sides of said channel so that said edges are above the normal maximum water line on said roof, and means for preventing water from entering the joints between said edges of said channel.

2. The joint construction of claim 1, wherein said preventing means includes a second inverted V-shaped channel having two sides and an apex, said second channel extending over said first channel with said edges of said sheets therebetween, waterproof means bonding one side of said second channel to an upper surface of said edge to said one side and waterproof means bonding the other side of said second channel to an upper surface of said adjacent edge of said other side.

3. The joint construction of claim 1, and further including means for circulating air under said sheets of material.

4. The joint construction of claim 3, wherein said air circulating means includes means for circulating air through the first of said generally V-shaped channels.

5. A roofing structure for a sloped building roof comprising a plurality of elongated sheets of flexible waterproof roofing material arranged on said building roof to extend parallel with adjacent edges of adjacent sheets extending down the roof slope, joint means extending along each pair of adjacent edges including a channel having two sides positioned beneath such pair of adjacent edges, each said channel including means raising such adjacent edges above the normal maximum water level on said roof, said adjacent edges of said sheets being bonded to opposite sides of said channels, and means for preventing water from entering the joints between said sheet edges and said channel.

6. The roofing structure of claim 5, and further including means for removing moisture from between said sheets of roofing material on said building roof.

7. The roofting structure of claim 6, wherein said moisture removing means includes means for circulating air through said channel.

8. A joint construction for adjacent edges of sheets of flexible waterproof roofing material in a roof structure, comprising an inverted generally V-shaped channel having first and second sides joined at an apex extending above the normal maximum water level on said roof structure, waterproof means bonding an adjacent edge of one sheet of said flexible waterproof roofing material to one side of said v-shaped channel, waterproof means bonding an adjacent edge of said other sheet to the other side of said channel, and means for preventing water from entering the joints between said edges and said channels including extending said edge of said one sheet over the apex and overlapping a portion of said adjacent edge of said other sheet and waterproof means bonding said overlapping portion of said edge of said one sheet to said adjacent edge of said other sheet.

9. The joint construction of claim 1 wherein a strip of metal is positioned on said roof structure beneath said channel and said flexible roofing material, said strip being positioned substantially perpendicular to said channel, means bonding said flexible roofing material to said strip.

* * * * *